US006990957B2

(12) United States Patent
Dingl et al.

(10) Patent No.: US 6,990,957 B2
(45) Date of Patent: Jan. 31, 2006

(54) METHOD FOR CONTROLLING A COMBUSTION ENGINE

(75) Inventors: Jürgen Dingl, Regensburg (DE); Michael Henn, Lehre (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/510,653

(22) PCT Filed: Mar. 12, 2004

(86) PCT No.: PCT/EP2004/002600

§ 371 (c)(1),
(2), (4) Date: Jun. 15, 2005

(87) PCT Pub. No.: WO2004/090313

PCT Pub. Date: Oct. 21, 2004

(65) Prior Publication Data

US 2005/0246090 A1 Nov. 3, 2005

(30) Foreign Application Priority Data

Apr. 9, 2003 (DE) ..... 103 16 291

(51) Int. Cl.
*F02M 7/00* (2006.01)

(52) U.S. Cl. ..... 123/434

(58) Field of Classification Search ..... 123/435, 123/434, 480, 90.1, 350, 704, 184.21
See application file for complete search history.

(56) References Cited

U.S. PATENT DOCUMENTS

| | | | | |
|---|---|---|---|---|
| 5,698,779 | A | 12/1997 | Yoshioka | |
| 6,574,956 | B1 * | 6/2003 | Moraal et al. | 60/295 |
| 6,871,632 | B2 * | 3/2005 | Henn et al. | 123/399 |
| 6,907,339 | B2 * | 6/2005 | Henn | 701/104 |

FOREIGN PATENT DOCUMENTS

| | | | |
|---|---|---|---|
| DE | 19547496 | A1 | 7/1997 |
| DE | 19706750 | A1 | 8/1998 |
| DE | 4325902 | C2 | 12/1999 |
| DE | 19844085 | C1 | 3/2000 |
| EP | 0522908 | A1 | 1/1993 |
| EP | 0589517 | A1 | 3/1994 |
| EP | 1030042 | A2 | 8/2000 |
| JP | 2002-155794 | | 5/2002 |
| WO | WO-97/35106 | A2 | 9/1997 |

* cited by examiner

*Primary Examiner*—Bibhu Mohanty
(74) *Attorney, Agent, or Firm*—Morrison & Foerster LLP

(57) ABSTRACT

The invention takes account of the residual gas exiting from the cylinder in order to reliably determine the air mass drawn in. To this end, the dependency of the air mass drawn in on the intake pressure is divided into three areas, from which the average area is modeled as a non-linear dependency of the air mass drawn in on the intake pressure.

9 Claims, 2 Drawing Sheets

METHOD FOR CONTROLLING A COMBUSTION ENGINE

CLAIM FOR PRIORITY

This application is a national stage of PCT/EP2004/002600, filed in the German language on Mar. 12, 2004, which claims the benefit of priority to German Application No. DE 10316291.7, filed on Apr. 9, 2003.

TECHNICAL FIELD OF THE INVENTION

The present invention relates to a method for controlling an internal combustion engine having an intake duct with at least one cylinder, an exhaust gas duct and inlet and exhaust values assigned to the cylinder.

BACKGROUND OF THE INVENTION

In combustion engines, when the inlet valves are opened, residual gas flows back into the intake duct. The fresh air to fill the cylinder thus contains a certain proportion of residual gas, which has to be taken into consideration when calculating the fresh air mass.

DE 198 44 085 C1 discloses a method for controlling an internal combustion engine as a function of an exhaust gas pressure. The method includes the step of calculating, with the aid of a model, an induction manifold pressure in the intake duct and the air mass flow into a cylinder. A correction factor is provided for the mean exhaust gas pressure during valve overlap, and is dependent on a center of gravity angle of the valve overlap.

EP 1 030 042 A2 discloses a method of determining cylinder filling of an engine without throttle. This method takes account of the fact that the residual gas pushed back into the inlet duct in front of the upper dead point is taken in again only after the intake operation. Assuming a so-called stopper model, the intake valve surface situated in front of the upper dead center is doubled and subtracted from the maximal valve opening surface.

SUMMARY OF THE INVENTION

The invention provides a method for controlling an internal combustion engine which reliably takes into account the residual gas flowing back into the inlet duct using simple means when determining the fresh air mass, especially in the case of valve overlap.

In one embodiment according to the invention, two critical values are provided for the induction manifold absolute pressure, in which the fresh air mass recorded and calculated in the model changes its dependency. Below the first and smaller critical value the recorded air mass is determined as proportional to the induction manifold pressure. The higher the induction manifold pressure, the larger the recorded fresh air mass. Above the second critical induction manifold pressure value the recorded fresh air mass is once again assumed as proportional to the induction manifold pressure. Nevertheless a constant value is added in this area to the fresh air mass resulting from the proportionality. The proportionality factor here can be the same or different. In a transitional area between the critical values the recorded fresh air mass is modeled as non-linearly dependent on the induction manifold pressure. In the invention, the dependency of the recorded fresh air mass on the induction manifold pressure is divided into two linear sections, between which a non-linear characteristic is envisaged.

In a preferred embodiment, the in-flowing air flow mass is determined in the intermediate area as a function of the quotient of induction manifold pressure and exhaust gas back pressure. This dependency is based on the consideration that in-flowing fresh air and out-flowing residual gas behave the same at the inlet valve as at a throttle point, so that the through-flow quantity essentially depends on the pressure quotient. Preferably the value dependent on the quotient is multiplied by a factor dependent on the speed and the valve overlap.

Furthermore it has proved advantageous for the transitional area to determine the non-linear characteristic as a function of the valve overlap and the engine speed.

In a preferred embodiment of the invention, the proportionality factor between in-flowing air mass and induction manifold pressure is made dependent on the speed and/or the position of the crankshaft when closing the inlet valve. To model the displacement between the linear areas, it has proved especially advantageous in a development of the inventive method to provide a first and second constant. Both constants are dependent on the speed, the first constant being dependent on a value for the valve overlap, while the second constant depends on the position of the crankshaft when closing the exhaust valves.

In another preferred embodiment of the invention, a pressure loss dependent on the speed of flow in the induction manifold is taken into account to determine the fresh air mass flowing into the cylinder. This correction term for the air mass is based on the consideration that an air mass flowing through the induction manifold at high speed experiences a pressure loss which increases quadratically from the speed of flow. This connection is described for ideal liquids by the BERNOULLI equation.

To implement the method it has proved advantageous to take account of the pressure loss dependent on the speed of flow as a function of one or more variable stored in a control device. Account is preferably taken here of the geometry, the duct resistance, position of a swirl flap, valve displacement, etc.

BRIEF DESCRIPTION OF THE DRAWINGS

The invention is described in greater detail below on the basis of a preferred exemplary embodiment. The figures show.

DETAILED DESCRIPTION OF THE INVENTION

Figure 1:
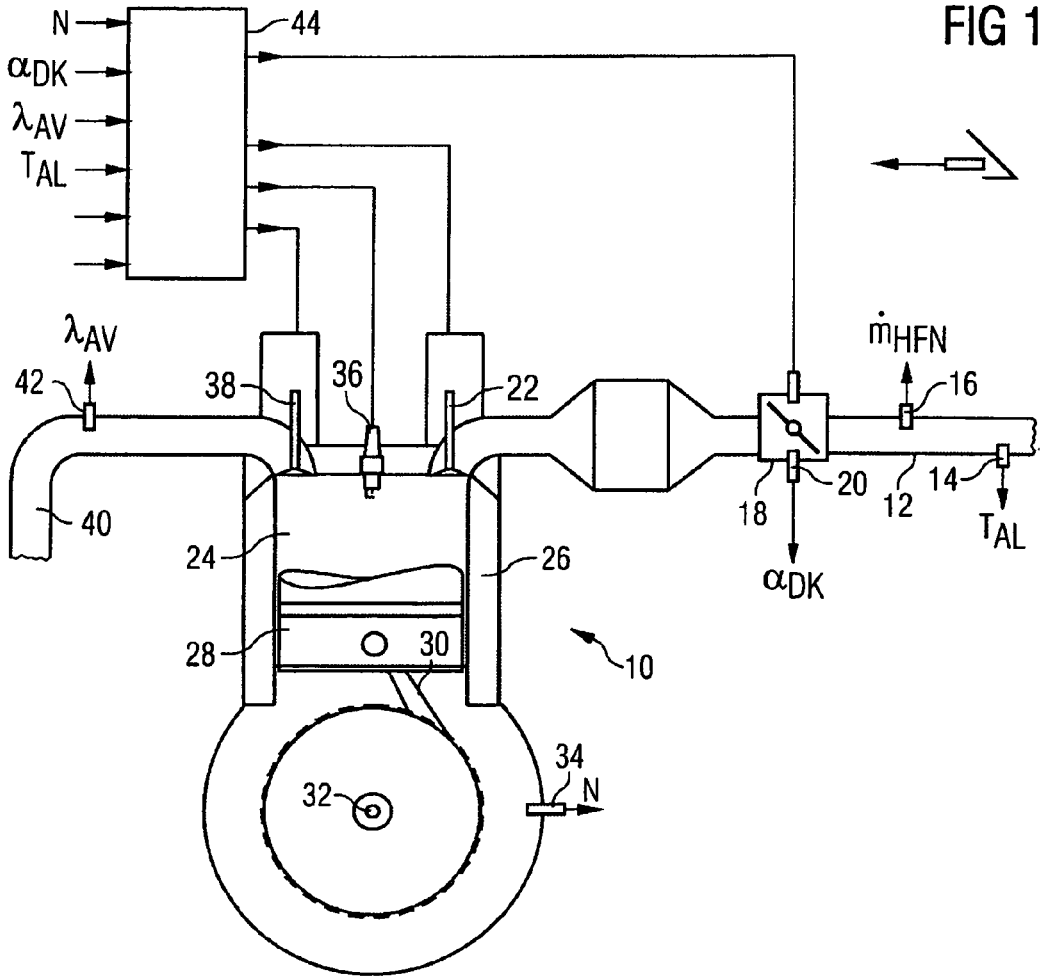
FIG. 1 show a diagrammatic view of an internal combustion engine.

FIG. 1 shows an internal combustion engine 10 with a cylinder by way of example. The invention can of course also be used for internal combustion engines with more than one cylinder. Fresh air is drawn in via an intake duct 12. The temperature of the fresh air is recorded using a temperature sensor 14. The incoming fresh air is for example measured by the air mass sensor 16. It is likewise possible to provide a pressure sensor as a charge sensor instead of an air mass sensor, the pressure sensor being positioned between throttle valve and inlet valve. A throttle valve 18 controls the air mass flow into the inlet duct. To provide better control, the angular position of the throttle valve is measured by a sensor 20.

The fresh air enters the interior of the cylinder 24 via an inlet valve 22.

The cylinder 26 is shown schematically and has a piston 28 with a connecting rod 30, which drives the crankshaft 32. The speed of the crankshaft 32 is recorded by a speed sensor 34.

The fuel injection is not shown in greater detail in the figures. The injected fuel is ignited using the ignition unit 36. Following ignition the residual gas is released into the exhaust gas duct 40 via the outlet valve 38. In the exhaust gas tract a lambda probe 42 measures the oxygen content contained in the exhaust gas.

The internal combustion engine is controlled by means of an engine control unit 44. The input variables present at the engine control unit 44 are the speed, the throttle valve angle, the oxygen content and the ambient temperature of the fresh air drawn in. Additionally the measured value for the fresh air drawn in is also present.

Figure 2:
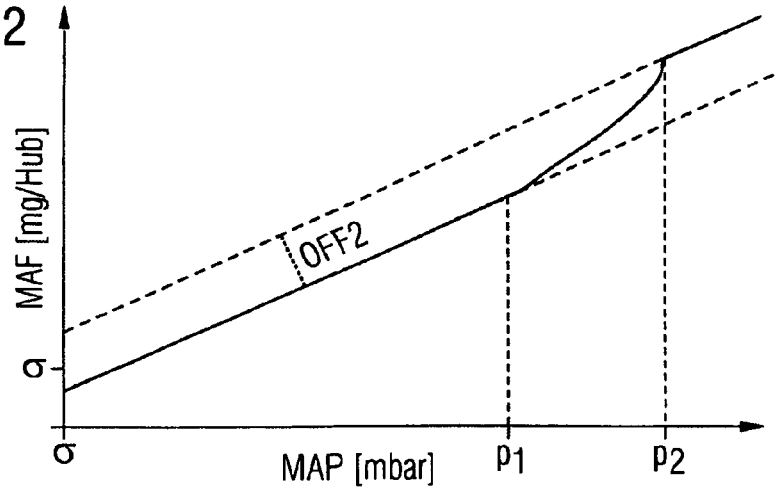
FIG. 2 show characteristics of the in-flowing air mass in a cylinder as a function of the induction manifold pressure.

FIG. 2 shows the model approach to the air mass flow into the cylinder as a function of the pressure in the induction manifold. If a pressure in the induction manifold is smaller than the first critical pressure P1, the air mass flow drawn in is modeled as proportional to the intake pressure. Examination of the set zero points along the axes shows that an air mass flow does not start in the cylinders until a certain minimum pressure is reached.

Above the second critical pressure P2 the air mass drawn in is again determined as proportional to the intake pressure, the straight line which follows the air mass flow being offset by an amount OFF2 compared to the original straight line. The straight lines are not necessarily parallel, but can also have different gradients. In the transition area between the pressure P1 and P2 the behavior is non-linear, and depends on the quotient of the intake pressure to the exhaust gas pressure in the form of a PSI functionality. The value of the offset OFF2 depends on the speed, the valve overlap VO and the quotient from induction manifold absolute pressure and exhaust gas pressure.

Unlike previous calculations of the air mass flowing into the interior of the cylinder 24, the invention takes account of the residual gas flowing back during the overlap phase in the mass balance. Of importance for this proportion which flows back when the inlet valve is opened are the valve control times, the ratio between inlet pressure and exhaust gas back pressure (at this moment this corresponds approximately to the combustion chamber pressure) and the time during which these conditions apply.

Figure 3:
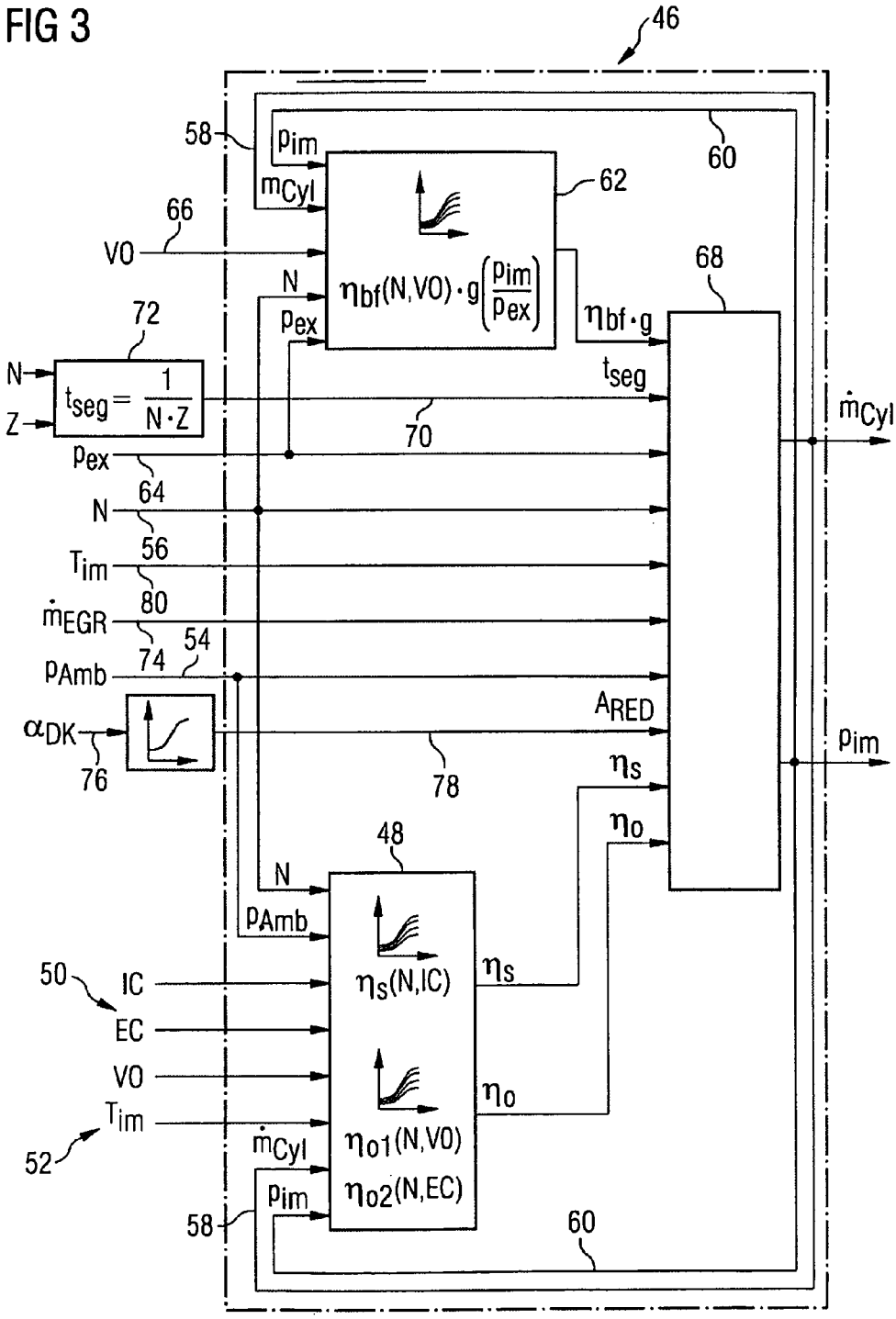
FIG. 3 show a block diagram for the invention.

FIG. 3 shows a block diagram for the invention. Before this block diagram is explained in greater detail, the physical model on which the block diagram is based should be described.

The mass flow in the cylinder is generally a function of the speed, the pressure in the intake duct $P_{im}$, the camshaft position when closing the inlet valves ES and the camshaft position when closing the exhaust valves AS. To suitably parameterize this complex dependency for the control of the internal combustion engine, the following approach has proved particularly advantageous:

$$\frac{dm_{cyl,0}}{dt} = \eta_s(N, ES)\cdot p_{im} - \eta_{o1}(N, VO) - \eta_{o2}(N, AS) + \eta_{bf}(N, VO)\cdot g\left(\frac{p_{im}}{p_{ex}}\right).$$

In this approach the speed N, the induction manifold absolute pressure $P_{im}$ and exhaust gas back pressure $P_{ex}$ are available as measured variables or are calculated by the engine control unit as a model value. The valve overlap is designated by VO, it being possible to measure the camshaft pressure or calculate it in the model.

In this approach the individual values can be stored in the characteristic fields and used for continuous calculation of $dm_{cy1,0}/dt$ and $p_{im}$. The curve of the characteristic lines is determined for an internal combustion engine by raster measurement or by means of targeted selection of particular operating points, for example by means of designs of experiments (DOE).

When calculating the gradient $\eta_s$(N,ES) and the constants $\eta_{01}$(N,VO) and $\eta_{02}$(N,AS) the low to average induction manifold absolute pressures are essentially taken into account. The dominant proportion for the air mass flow in the cylinder is:

$$\frac{dm_{cyl,01}}{dt} = \eta_s(N, ES)\cdot p_{im} - \eta_{o1}(N, VO) - \eta_{02}(N, AS)$$

Since the difference from the exhaust gas back pressure is the greatest at low induction manifold absolute pressures, the greatest volume of residual gas is pushed back into the intake duct under these conditions, as a result of which less fresh air reaches the combustion chamber until the end of the charge cycle.

The main influence on the total mass pushed back to the intake duct is, besides the valve control times and the pressure ratio, the available time. This also explains why this effect is particularly evident at low speeds.

With known characteristic figures for gradient and displacement, the fresh air drawn in can be well calculated up to a first critical variable P1. As the induction manifold pressure increases, ever greater deviations occur between what is actually drawn in by the engine and the linear dependency described above for the calculated fresh air charge. This is caused by the declining pressure difference as the induction manifold absolute pressure increases between induction manifold and exhaust gas line. This deviation is taken into account by the following expression:

$$\eta_{bf}(N, VO)\cdot g\left(\frac{p_{im}}{p_{ex}}\right).$$

In order to determine the variables the air mass flow into the cylinder is measured and is adjusted to the increasing intake manifold absolute pressure.

Once the characteristic lines have been determined and stored in a control unit, the intake pressure and the air mass flow into the cylinders can be continually calculated. As shown in FIG. 3, the constants $\eta_{01}$(N,VO) and $\eta_{02}$(N,EC) are determined in a module 48 of the control unit 46. Furthermore, the gradient $\eta_s$(N,IC) is also calculated, whereby IC here designates the angular position when closing the inlet valve, EC the angular position when closing the exhaust valve and VO 66 the valve overlap. The angular position when closing intake and exhaust valve, as well as the angular overlap VO 66 are present at the control module 48 as input variables. The gas temperature 52 from the inlet duct is also present. The ambient pressure $p_{amb}$ 54 is taken into account, as is the speed 56. Also present at the module 48 are the values determined in the last method step for the in-flowing air mass 58 and the pressure in the inlet area 60. The term dependent on the quotient of the pressure in the inlet and the exhaust duct is determined in order to determine the non-linear transition area. To this end, the pressure in the exhaust duct 64 and the pressure in the inlet duct 60 calculated by the model in the previous step is present as an input variable. Likewise the value calculated in the previous method step for the mass flow into the cylinder is also present at the unit 62.

A new value for the air mass flow into the cylinder and for the pressure in the inlet duct is calculated in the block 68 from the variables determined in this way. The duration of a segment 70 calculated in a previous step 72 can also be taken into account here. Additionally, where exhaust gas recirculation is present, the mass flow $dm_{EGR}/dt$ 74 arising from the exhaust gas recirculation is also taken into account. With the aid of the throttle valve angle 76 the reduced cross-sectional area 78 in the inlet duct is determined, so that in the case of high flow speeds the speed-dependent flow losses are taken into account. In order to determine the gas density in the inlet duct the gas temperature 80 in the intake duct is also present at the inlet duct.

What is claimed is:

1. A method for controlling an internal combustion engine with an intake duct, at least one cylinder, an exhaust gas duct and inlet and exhaust valves, assigned to the at least one cylinder, comprising calculating a fresh air mass flowing into the at least one cylinder up to a first critical value of the induction manifold pressure which is proportional to the intake pressure, and as of a second critical value of the induction manifold pressure which is proportional to the intake pressure plus an air mass constant and which runs non-linearly in a transitional area between the two critical values for the induction manifold pressure.

2. The method according to claim 1, wherein for the transitional area, the in-flowing air mass becomes dependent on a quotient of the induction manifold pressure and exhaust gas back pressure.

3. The method according to claim 2, wherein the value dependent on the quotient is multiplied by a factor dependent on speed and valve overlap.

4. The method according to claim 3, wherein for the transitional area, the in-flowing mass air is determined as a function of valve overlap and engine speed.

5. The method according to claim 4, wherein a proportionality factor between the in-flowing fresh air mass and the induction manifold pressure is dependent on the speed and/or the position of a crankshaft when the inlet valve is closed.

6. The method according to claim 5, wherein the air mass constant has a first constant the value of which depends on the speed and a value for the valve overlap.

7. The method according to claim 6, wherein the air mass constant has a second constant, the value of which depends on the speed and the position of the crankshaft when the exhaust valves are closed.

8. The method according to claim 7, wherein for the fresh air mass flowing into the cylinder, a pressure loss dependent on the speed of flow in the induction manifold is taken into account.

9. The method according to claim 8, wherein the pressure loss dependent on the speed of flow is determined as a function of one or more variables stored in the control devices.

* * * * *